United States Patent [19]

Haas

[11] 4,141,370

[45] Feb. 27, 1979

[54] HAIR ROLLER

[75] Inventor: David L. Haas, Norwalk, Conn.

[73] Assignee: Sperry Rand Corporation, Bridgeport, Conn.

[21] Appl. No.: 741,611

[22] Filed: Nov. 15, 1976

[51] Int. Cl.[2] ..... A45D 2/02

[52] U.S. Cl. ..... 132/39

[58] Field of Search ..... 132/39, 40, 42, 34; 229/41 B–41 C, 93

[56] References Cited

U.S. PATENT DOCUMENTS

| | | | |
|---|---|---|---|
| 1,545,771 | 7/1925 | Hout | 229/41 B |
| 2,226,178 | 12/1940 | Page | 229/41 B |
| 2,369,385 | 2/1945 | Carruth et al. | 229/41 B |
| 2,402,944 | 7/1946 | Braloff | 229/41B |
| 2,652,063 | 9/1953 | Seyffarth | 132/43 R |
| 2,965,280 | 12/1960 | Miller | 229/41 C |
| 3,108,603 | 10/1963 | Mobberley | 132/34 |
| 3,713,455 | 1/1973 | Chen | 132/40 |
| 3,747,830 | 7/1973 | Goldman | 229/41 B |
| 3,912,331 | 10/1975 | Turner | 229/41 B |
| 4,022,226 | 5/1977 | Muenstermann | 132/40 |

*Primary Examiner*—G.E. McNeill

*Attorney, Agent, or Firm*—Charles R. Miranda; Joseph S. Failla

[57] ABSTRACT

A hair roller is described which is adapted to be expanded from a substantially flat configuration into an elongated, cylindrically shaped body which is substantially resistant to bending and buckling. The hair roller comprises first and second generally planar, flexible roller members which are hinge coupled for enabling resilient deflection of the members into a body having a generally cylindrically shaped configuration. A fastening means is provided for maintaining the body in the deflected, cylindrically shaped configuration.

10 Claims, 10 Drawing Figures

Fig. 1.
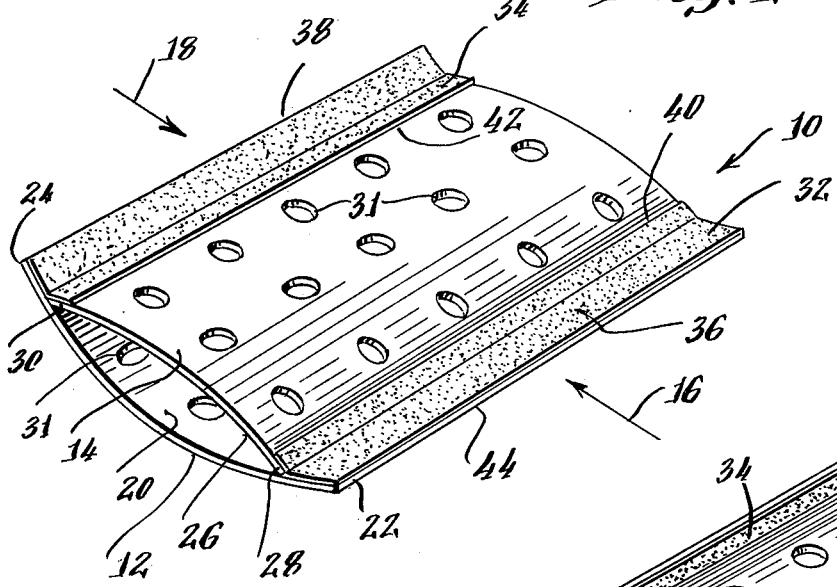
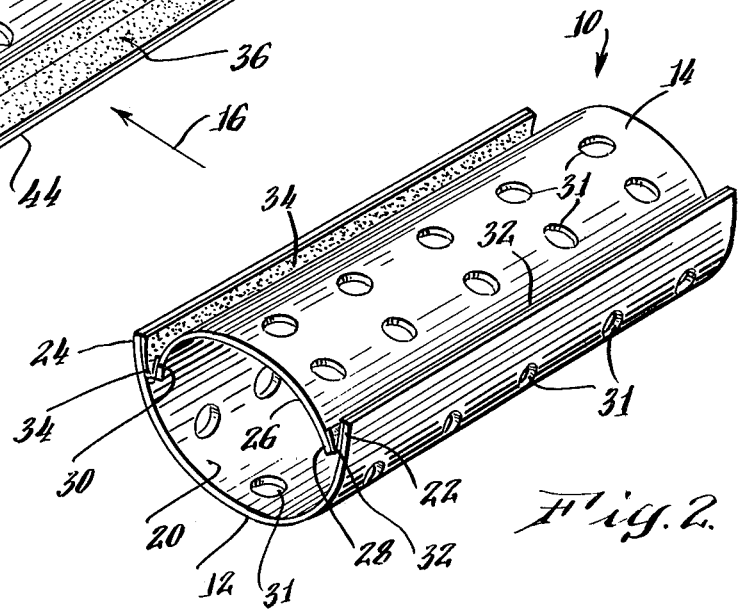
Fig. 2.
Fig. 3.
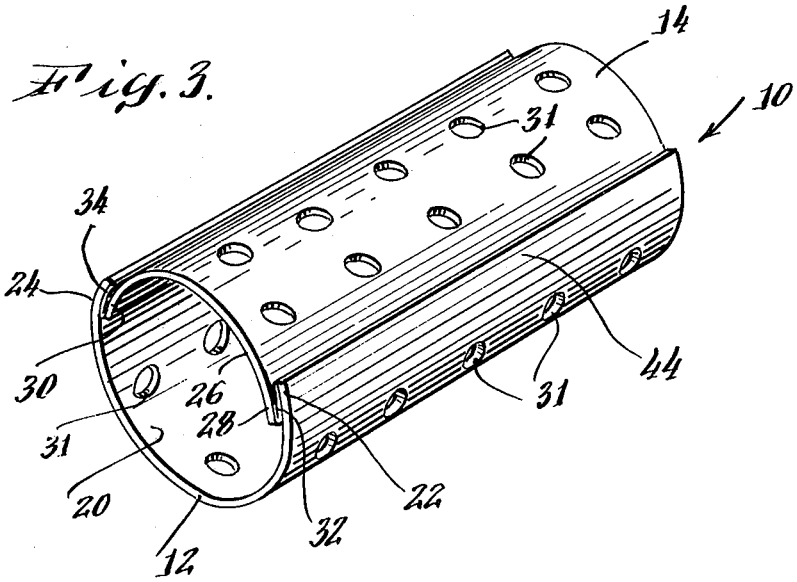

HAIR ROLLER

BACKGROUND OF THE INVENTION

This invention relates to hair rollers and, more particularly, to an improved form of cylindrically shaped hair roller which may be stored flat.

The use of rollers for the styling and setting of hair is well known. In one arrangement, a hair roller body, which is generally cylindrically shaped is provided and a person's hair is wound about and secured to the roller body. The hair thus formed on the roller body can be warmed to enhance setting. Alternatively, the hair remains wound about the curling body for an extended period of time to achieve setting under ambient air conditions.

The use of hair rollers is facilitated when the cylindrically shaped roller body is substantially resistant to bending and buckling. However, it is also desirable for purposes of packaging by the manufacturer and storage by the user to provide a roller of this type which can be stored in a substantially flat configuration.

Accordingly, it is an object of this invention to provide a hair roller having a generally flat configuration for storage and which is adapted to be expanded to a generally cylindrically shaped body which is substantially resistant to bending and buckling.

SUMMARY OF THE INVENTION

In accordance with the general features of this invention, a hair roller which is adapted to be expanded from a substantially flat configuration into an elongated, cylindrically shaped body which is substantially resistant to bending and buckling is provided. The hair roller comprises a first flexible, planar shaped roller member having a surface including first and second longitudinally extending edges and a second, flexible generally planar shaped roller member having a surface including first and second longitudinally extending edges. A hinge means provides a hinge coupling between the first and second roller members. The surfaces of the coupled roller members are positioned in juxtaposed relationship and are resiliently deflectable from a generally planar configuration into a body having a generally cylindrically shaped configuration. A fastening means is provided for maintaining the body in the deflected cylindrically shaped configuration.

In accordance with features of a particular embodiment of the invention, the roller members are generally rectangular shaped, are substantially equal in length and the second roller member is narrower in width than the first roller member. The hinged coupling means provides first and second hinged couplings between the first and second edges respectively of the second roller member and the surface of the first roller member. Because of the difference in width, the hinge coupling creates integral tab segments in the first roller member which extend from the hinges to edges of the first roller member. The application of a force to these tabs causes the roller members to bend into a generally cylindrically shaped body. In accordance with another feature of this embodiment of the invention, double sided adhesive strips provide for hinge coupling and fastening of the roller members.

In accordance with features of another embodiment of the invention, the roller members have a substantially same rectangular cross sectional configuration and hinge coupling is provided between the first edges of the roller members and between the second edges of the roller members. A fastening means comprises a fastener member which is hinged to one of the members and is adapted to extend in a plane parallel to the planar members and to be rotated and engage the other roller member when the roller members are bent into a generally cylindrically shaped configuration.

BRIEF DESCRIPTION OF THE DRAWINGS

These and other objects and features of the invention will become apparent with reference to the following specifications and to the drawings wherein:

FIG. 1 is a perspective view of one embodiment of the hair roller of the present invention illustrating the roller in an undeflected, generally planar configuration for storage;

FIG. 2 is a perspective view of the hair roller of FIG. 1 and illustrates the hair roller at an intermediate step during the process of bending the roller into a generally cylindrically shaped body;

FIG. 3 is a perspective view of the hair roller of FIG. 1 illustrating the hair roller deflected and fastened in a generally cylindrically shaped configuration;

DETAILED DESCRIPTION OF THE INVENTION

Figures 4, 5, 6, 7, 8, 9, 10:
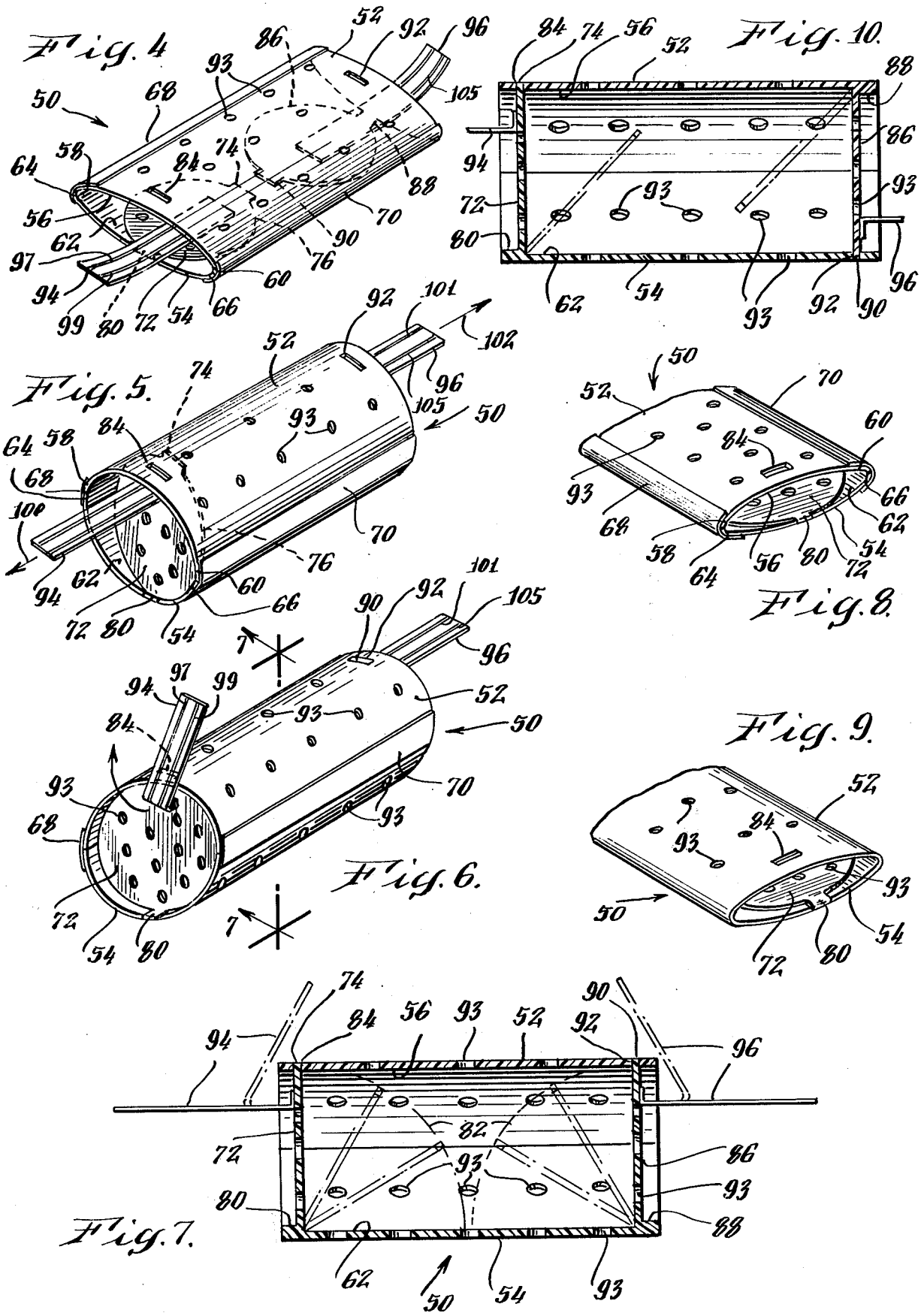
FIG.4 is a perspective view of an alternative embodiment of the hair roller of this invention and illustrating the hair roller in an undeflected, generally planar configuration.
FIG. 5 is a perspective view illustrating the hair roller of FIG. 4 at an intermediate step during the process of bending the roller into a cylindrically shaped body.
FIG. 6 is a perspective view of the hair roller of FIG. 4 illustrating the hair roller deflected and fastened in a generally cylindrically shaped configuration.
FIG. 7 is a sectional view taken along a plane 7—7 of FIG. 6.
FIG. 8 is a fragmentary perspective view of an assembly of hair roller members of FIG. 4.
FIG. 9 is a fragmentary perspective view of an alternative assembly of the hair roller members of FIG. 4; and, FIG. 10 is a sectional view illustrating an alternative arrangement of the hair roller of FIG. 7.

Referring now to FIG. 1, a hair roller 10 is shown to comprise a first generally planar, flexible member 12 and a second generally planar, flexible member 14. The members 12 and 14 are formed of a material and have a thickness for exhibiting a resilient flexibility when deflected in the direction of the width of the hair roller 10. This direction is indicated in FIG. 1 by the arrows 16 and 18. The first roller member 12 has a first surface 20 and longitudinally extending edges 22 and 24. The second sheet 14 has a first surface 26 and longitudinally extending edges 28 and 30. Each of the members has a plurality of apertures 31 formed therein for enhancing air flow through the roller when expanded as shown in FIG. 3 and to enhance application of hair treatment materials. In providing the desired resilient flexible characteristics, the members 12 and 14 are formed of various suitable materials. In one arrangement the members are formed from a sheet of a polymer plastic such as polypropylene having a thickness in the range of about 0.010 inches to 0.015 inches (0.025 CM to 0.038 CM).

A means for hinge coupling the edges 28 and 30 of the second roller member to the surface 20 comprises a first adhesive strip 32 and a second adhesive strip 34 respectively. The width of the second roller member 14 is less than the width of the first roller member 12 and a relatively narrow longitudinally extending edge segment 36 is provided between the edge 22 and the edge 28 and a second relatively narrow longitudinally edge segment 38 is provided between the edge 24 and the edge 30. The adhesive strip 32 adheres to the longitudinally extending edge segment 36 and to a longitudinally extending edge segment 40 of the body 14 thereby providing a hinge coupling between the edge 28 of the second member 14 and the surface 20 of the first member 12. Similarly, the strip 34 adheres to the longitudinally extending edge segment 38 and a longitudinally extending edge segment 42 of the member 14 thereby providing a hinge coupling between the edge 30 and the surface 20. The members 12 and 14 are thereby hinge coupled and their surfaces 20 and 26 respectively are in juxtaposed relationship when the hair roller 10 is collapsed in the generally planar configuration of FIG. 1

The members 12 and 14 are resiliently deflectable from the planar configuration of FIG. 1 into a hair roller body having a generally cylindrically shaped configuration as is illustrated in FIG. 3. This is accomplished by applying a force with the fingers to a second surface 44 of the member 12 in the vicinity of the edge segments 36 and 38 and in a direction indicated generally by the arrow 16 and 18. The members deflect and pivot about the hinge coupling and the deflection progresses, as illustrated in FIG. 2, toward the cylindrically configured body of FIG. 3. This arrangement is advantageous in that the roller body is deflectable with one hand into the generally cylindrically shaped body of FIG. 3.

A fastener means is provided for maintaining the deflected members in the cylindrically configured body of FIG. 3. This means comprises the adhesive strips 32 and 34 which are double sided adhesive strips and which, when folded over upon themselves as illustrated in FIGS. 2 and 3, establish an adhering contact which maintains the body in the cylindrical configuration of FIG. 3. A strip of release paper, which for purposes of clarity in the drawings is not illustrated, is positioned on the upper adhesive surface of each of the strips 32 and 34 as seen in FIG. 1 and inhibits the flattened hair roller from adhering to other hair rollers or objects when stacked or stored. The width of adhesive strips adhering to edge segment 40 is less than that adhering to edge segment 36 so as not to expose any adhesive to attach to hair wound on the roller.

Referring now to FIGS. 4 through 8, an alternative embodiment of the hair roller of this invention is illustrated. As best illustrated in FIG. 8, the hair roller 50 comprises first and second, flexible, planar shaped roller members 52 and 54. The member 52 has a first surface 56 and first and second longitudinally extending edges 58 and 60. The member 54 has a surface 62 and longitudinally extending edges 64 and 66.

A means for hinge coupling the edges is provided and comprises a first elongated adhesive strip 68 which couples the edges 58 and 64 and a second elongated adhesive strip 70 which couples the edges 60 and 66. Alternative to an adhesive strip, the strips 68 and 70 can be heat sealed to the respective edges. The surfaces 56 and 62 of the members 52 and 54 respectively are positioned in juxtaposed relationship when the hair roller is flattened as illustrated in FIGS. 4 and 8. Roller members 52 and 54 are formed of a flexible material as described hereinbefore with respect to FIGS. 1–3 and the members are resiliently deflectable from the planar configuration illustrated in FIGS. 4 and 8 into a body having a cylindrically shaped configuration as illustrated in FIGS. 6 and 7.

Fastening means for maintaining the body in the cylindrically shaped configuration comprises a circular disk shaped fastener member 72 having an integrally formed tab segment 74 extending from a periphery 76. A hinging means is provided for hinge coupling the fastener member 72 to the surface 62 of the roller member 54. The fastener hinge means comprises a flanged back segment 80 of the roller member 54 which is integrally formed both with the member 54 and with the fastener member 78. During fabrication, the member 54, the fastener member 72 and the flange segment 80 are stamped or cut from a same sheet. Alternatively, the fastener member is an independent disk and is hinged to member 54 by a tape or other suitable means. The fastener member 72 is rotatable about the hinge segment 80 in an arcuate path of travel 82 as illustrated in FIG. 7.

A means establishing engagement between the fastener member 72 and the second hair roller member 52 comprises the tab segment 74 and a slot 84 which receives and engages the tab segment. The fastener member 72 thereby engages the member 52 and maintains the expanded body in a generally cylindrical configuration.

In addition to the fastener member 72, a second fastener member 86 is provided and is hinge mounted to the surface 62 of the member 54 by an integrally formed flange 88 and includes an integrally formed tab 90 for engaging a slot 92 formed in the member 52.

Each of the roller body members 52 and 54 and the fastener members 72 and 86 include a plurality of apertures 93.

A means for rotating the fastener members 72 and 86 about the hinge segments 80 and 88 and for causing the hair curler 50 of FIG. 4 to expand to the cylindrical body of FIG. 6 comprises grip segments 94 and 96 which are coupled to the fastener members 72 and 86 respectively. By pulling these grip segments with finger force in the direction of the arrows 100 and 102 (FIG. 5), the fastener members 72 and 76 are caused to rotate, contact the surfaces 56 and 62 of the members 52 and 54 and force them to deflect into the shape of the cylindrical body of FIG. 6. The segments 94 and 96 are integrally formed with the fastener members 72 and 86 respectively, or, alternatively as illustrated in FIG. 7, they can be secured thereto by a suitable adhesive such as an epoxy, by heat staking or by a mechanical coupling.

In addition to providing a gripping means for rotating the fastener members, the grip segments 94 and 96 can be bent over as illustrated in FIGS. 6 and 7 and serve to function as hair clips for hair wound about the roller 50. To this end deformable wires 97 and 99 are formed in the grip 94 and wires 101 and 105 are formed in the grip 96. These wires may be molded or extruded with the grips.

An alternative arrangement of the hinged coupled hair roller members 52 and 54 is illustrated in FIG. 9. In this arrangement, the members 52 and 54 and the hinging means are integrally formed. This is accomplished, for example, by flattening a tubular segment formed of the desired tubular material. In this case, the fastener member 72 is hinge mounted to the roller member 54 by an additional means such as a tape or alternatively, it is heat staked to the member 54. The use of the arrangement of FIG. 9 is, in other respects, the same as was described with respect to FIGS. 4–7.

While the fastener members 72 and 86 are each illustrated as being supported from the surface 62 of the member 54, it is beneficial from a manufacturing and cost viewpoint to form the fastener member 72 and aperture 92 on the roller member 54 and the fastener member 86 and aperture 84 on the roller member 52 as is illustrated in FIG. 10. With this arrangement, only a single piece need be fabricated and any possible interference between the grip segments 94, 96 when flanged over the adjacent surface would be eliminated.

An improved hair roller has thus been described which is resistant to buckling and bending, which can be stored in a generally flat condition and which can be expanded into a body having a generally cylindrical configuration.

While there has been described particular embodiments of the invention, various modifications will occur to those skilled in the art without departing from the spirit of the invention and the scope of the appended claims.

What is claimed is:

1. A hair roller resiliently expandable from a substantially flat storage configuration into an elongated generally cylindrical-shaped body which is substantially resistant to bending and buckling to externally applied finger force when readied for use, said hair roller comprising;

a. two resiliently flexible rectangular shaped substantially flat body members having a width and substantially the same length, b. each of said body members having laterally opposed longitudinal marginal portions terminating in longitudinal edges, said body members being arranged in a substantially flat overlying relationship to each other with said opposed marginal portions of each body member arranged in an aligned coextensive relationship forming adjacent parallel pairs of marginal portions, c. means secured to each of said body members adjacent said longitudinal edges in bridging relationship to each of said adjacent parallel pairs of marginal portions for hinge coupling said body members to each other forming a hinge coupled hair roller having a pair of laterally opposed hinges and a substantially flat configuration, d. means arranged on said hair roller operable for resiliently deflecting the body members in cooperation with said laterally opposed hinges from said flat overlying relationship to an arcuate spaced apart relationship to form the hair roller into a generally cylindrical shaped configuration, e. means secured to said deflecting means and releasably engageable with one of said body members for maintaining said hair roller in said deflected cylindrical configuration, and f. the resiliency of said body members in cooperation with said laterally opposed hinges urging said hair roller to automatically assume said substantially flat configuration upon release of said maintaining means from said one of the body members.

2. The hair roller of claim 1 wherein the width of one of said body members is narrower than the width of the other of said body members, said one body member having the longitudinal edges thereof in a recessed parallel relationship with the longitudinal edges of said other body member, the marginal portions of said other body member extending beyond said recessed longitudinal edges in a direction transverse of said one body member, and said hinge coupling means being secured to the marginal portions of said body members in a bridging relationship to said recessed longitudinal edges of the one body member.

3. The hair roller of claim 2 wherein said deflecting means include integral opposed tab segments formed on the transversely extending marginal portions of said other body member, and said maintaining means being arranged on said tab segments and releasably engageable with the opposed marginal portions of said one body member.

4. The hair roller of claim 3 wherein said hinge coupling means include a pair of elongated strip members having opposed first and second surfaces, a portion of said first surfaces being secured to said tabs segments and another portion of said first surfaces being secured to the marginal portions of said one body member in said bridging relationship to said recessed longitudinal edges thereof, said maintaining means including an adhesive material secured to said second surfaces of the strip members, said adhesive releasably engaging the marginal portions of said one body member upon deflection of said hair roller body into said cylindrical configuration.

5. The hair roller of claim 1 wherein said body members have substantially the same width, said body members being arranged in said overlying relationship with said longitudinal edges of one of said body members in an aligned coextensive relationship with corresponding longitudinal edges of the other of said body members, and said hinge coupling means being secured to said marginal portions of the body members in bridging relationship to said aligned longitudinal edges of the body members.

6. The hair roller of claim 5 wherein said deflecting means include a fastener member having opposed ends, one end of said fastener member being rotatably secured to one of said body members, the opposite end of said fastener member extending within said substantially flat hair roller body on a plane parallel to and between the overlying body members, said fastener member being operable for rotation within said hair roller body for engagement of the opposite end of the fastener member with the other of said body members for deflecting the hair roller body into said cylindrical shaped configuration.

7. The hair roller of claim 6 wherein said fastener member is provided with a finger gripping member operable from outside said hair roller body for rotating the fastener member into said deflecting engagement with said other body member.

8. The hair roller of claim 7 wherein said finger gripping member comprises a deformable elongated hair clip member formed of a pair of encased wires, said hair clip is adapted to be bent over and extend over the outer surface of the hair roller for securing hair which is wound around said hair roller to the hair roller.

9. The hair roller of claim 5 wherein said deflecting means include a pair of fastener members each having opposed ends, one end of each of said fastener members being rotatably secured to opposite ends of said body members, the opposite ends of said fastener members extending within said substantially flat hair roller body on a plane parallel to and between the overlying body members, said fastener members each being operable for rotation within said hair roller body for engagement of said opposite ends of the fastener member with one of said body members for deflecting the hair roller body into said cylindrical shaped hair roller, and said maintaining means including tabs formed on each of said opposite ends of the fastener members and slots formed in said one body member for releasably receiving and engaging said tabs therein.

10. The hair roller of claim 9 wherein said fastener members are provided with finger gripping members comprising a deformable elongated hair clip member each formed of a pair of encased wires, said finger gripping members operable from outside said hair roller body for rotating the fastener members into said deflecting engagement with said one body member, and said hair clip is adapted to be bent over and extend over the outer surface of the hair roller for securing hair which is wound around said hair roller to the hair roller.

* * * * *